US005546839A

United States Patent [19]

Gardiner

[11] Patent Number: 5,546,839

[45] Date of Patent: Aug. 20, 1996

[54] PNEUMATIC EJECTOR

[76] Inventor: Richard Gardiner, Parish Mill, Longhope, Gloucestershire, England

[21] Appl. No.: 282,458

[22] Filed: Jul. 29, 1994

[30] Foreign Application Priority Data

Aug. 4, 1993 [GB] United Kingdom ..... 9316126

[51] Int. Cl.[6] ..... B26D 7/06

[52] U.S. Cl. ..... 83/128; 83/137; 83/123

[58] Field of Search ..... 83/128, 124, 123, 83/111, 145, 109, 118, 129, 133, 137

[56] References Cited

U.S. PATENT DOCUMENTS

| | | | |
|---|---|---|---|
| 2,041,530 | 5/1936 | De Witt et al. | 83/137 |
| 3,524,368 | 8/1970 | Goldman | 83/123 |
| 3,606,824 | 9/1971 | Remington . | |
| 3,827,322 | 8/1974 | Saunders et al. | 83/128 |
| 3,939,743 | 2/1976 | Coombes | 83/123 |
| 5,365,815 | 11/1994 | Pfaff, Jr. | 83/128 |

FOREIGN PATENT DOCUMENTS

| | | | |
|---|---|---|---|
| 0090885 | 10/1983 | European Pat. Off. . | |
| 2507948 | 12/1982 | France . | |
| 3019087 | 11/1981 | Germany . | |
| 56-019739 | 2/1981 | Japan . | |
| 1382539 | 3/1988 | U.S.S.R. . | |
| 19037 | of 1893 | United Kingdom | 83/124 |
| 1336162 | 11/1973 | United Kingdom . | |
| 2021734 | 12/1979 | United Kingdom . | |
| 2116632 | 9/1983 | United Kingdom . | |
| 2224967 | 5/1990 | United Kingdom . | |
| WO91/05640 | 5/1991 | WIPO . | |

*Primary Examiner*—Rinaldi I. Rada
*Assistant Examiner*—Elizabeth Stanley
*Attorney, Agent, or Firm*—Young & Thompson

[57] ABSTRACT

A pneumatic ejector comprises a rigid support member having a base portion and an upstanding boss integral with the base portion, and an elastomeric ejection element having a diaphragm portion and a skirt portion surrounding the diaphragm portion and secured to the boss. The support member has an air inlet passage for supplying air under pressure to move the diaphragm away from the boss. The upper end of the upstanding boss is concave and the diaphragm is of complementary shape. The diaphragm has an integral protrusion upstanding from a central region of the diaphragm. Additionally, the diaphragm has an integral protrusion which depends from a central region of the diaphragm and which extends into a through bore in the upstanding boss, the through bore communicating with the air inlet passage in the support member.

6 Claims, 3 Drawing Sheets

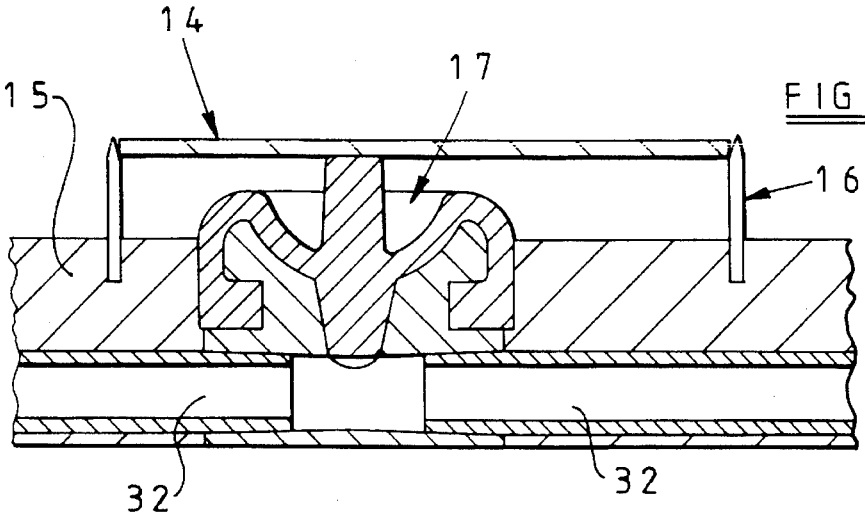
FIG 5
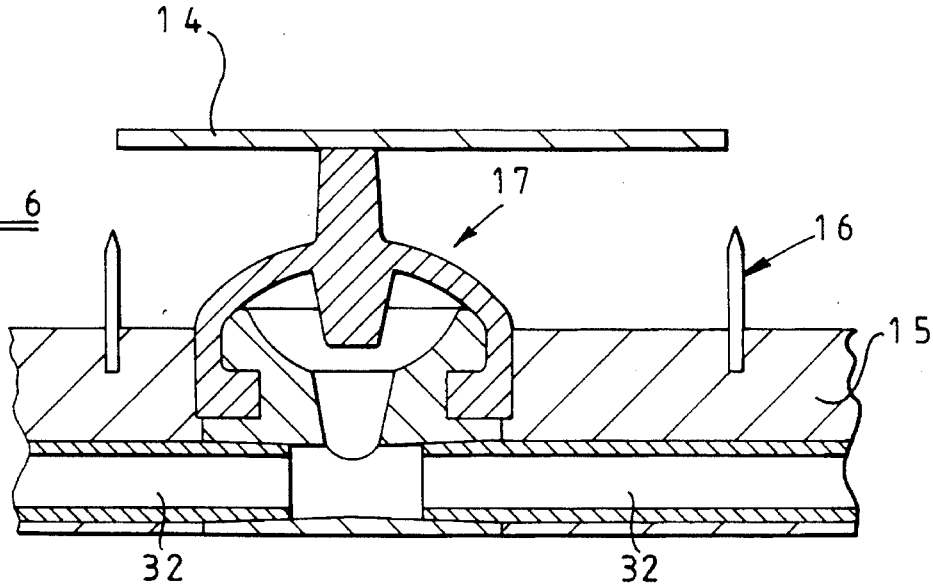
FIG 6
FIG 7
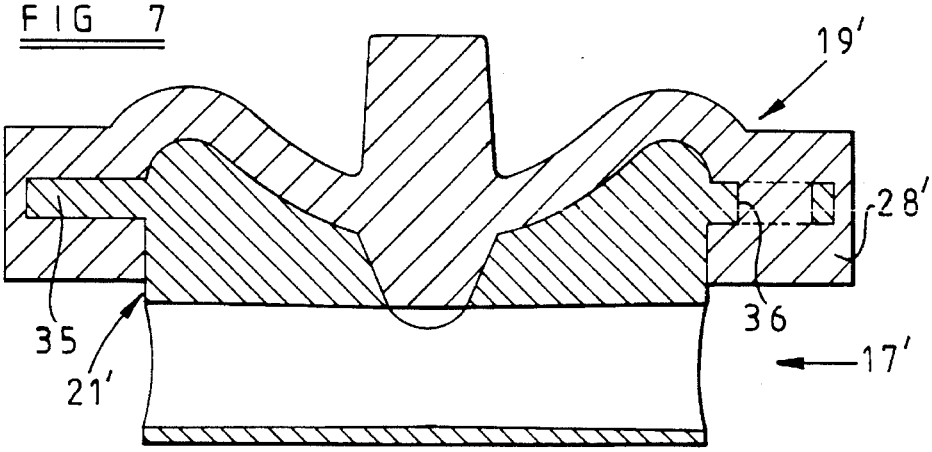

PNEUMATIC EJECTOR

This invention relates to a pneumatic ejector and more particularly to such an ejector for ejecting cut sheet from between the cutting blades of a die-cutting press, and to a die-cutting press equipped with such ejectors.

Known pneumatic ejectors comprise a plastics base and an elastomeric bellows device attached to the base by trapping the lowermost part of the bellows device between a plastics disc and the plastics base. The disc has an internally threaded hub which threadably engages an externally threaded boss on the base and the boss has a through bore which communicates with an air inlet passage in the base. The bellows device contracts as the board is cut in the die cutting press and is expanded by pressurised air supplied by way of the air inlet passage in the base to eject the cut sheet from between the cutting blades of the press.

The present invention seeks to provide a pneumatic ejector in an improved form.

SUMMARY OF THE PRESENT INVENTION

According to a first aspect of the present invention there is provided a pneumatic ejector comprising a rigid support member having a base portion and an upstanding boss integral with the base portion, and an elastomeric ejection element having a diaphragm portion and a skirt portion surrounding the diaphragm portion and secured to the boss, the support member having an air inlet passage for supplying air under pressure to move the diaphragm away from the boss.

Preferably, the skirt portion is moulded onto the upstanding boss. Additionally or alternatively, the skirt portion is bonded to the upstanding boss by adhesive.

Preferably, the upstanding boss has an annular, circumferential groove receiving a part of the skirt portion of the ejection element.

Preferably, the upper end of the upstanding boss is concave and the diaphragm is of complementary shape.

Preferably, the diaphragm has an integral protrusion upstanding from a central region of the diaphragm.

Advantageously, the diaphragm has an integral protrusion which depends from a central region of the diaphragm and which extends into a through bore in the upstanding boss, said through bore communicating with the air inlet passage in the support member.

According to a second aspect of the invention there is provided a die-cutting press comprising a movable bed supporting a die for cutting a sheet, a pressing roller for applying pressure to the combination of the die and the sheet supported on the bed to form the required cuts in the sheet, a drive unit for rotating the pressing roller and for moving the bed relative to the pressing roller so that the combination of the die and the sheet is roll pressed between the pressing roller and the bed, a support roller for supporting the bed during movement of the bed relative to the pressing roller, and one or more pneumatic ejectors according to the first aspect of the invention for ejecting cut sheet from between cutting blades of the die.

The invention will now be more particularly described, by way of example, with reference to the accompanying drawings.

BRIEF DESCRIPTION OF THE DRAWINGS

FIG. 5 is a diagrammatic sectional view showing the ejector in a die base and in a first condition;

FIG. 6 is a diagrammatic sectional view showing the ejector in a die base and in a second condition, and FIG. 7 is a sectional view, similar to FIG. 3, of another embodiment of a pneumatic ejector according to the invention.

DESCRIPTION OF THE PREFERRED EMBODIMENTS

Figure 1:
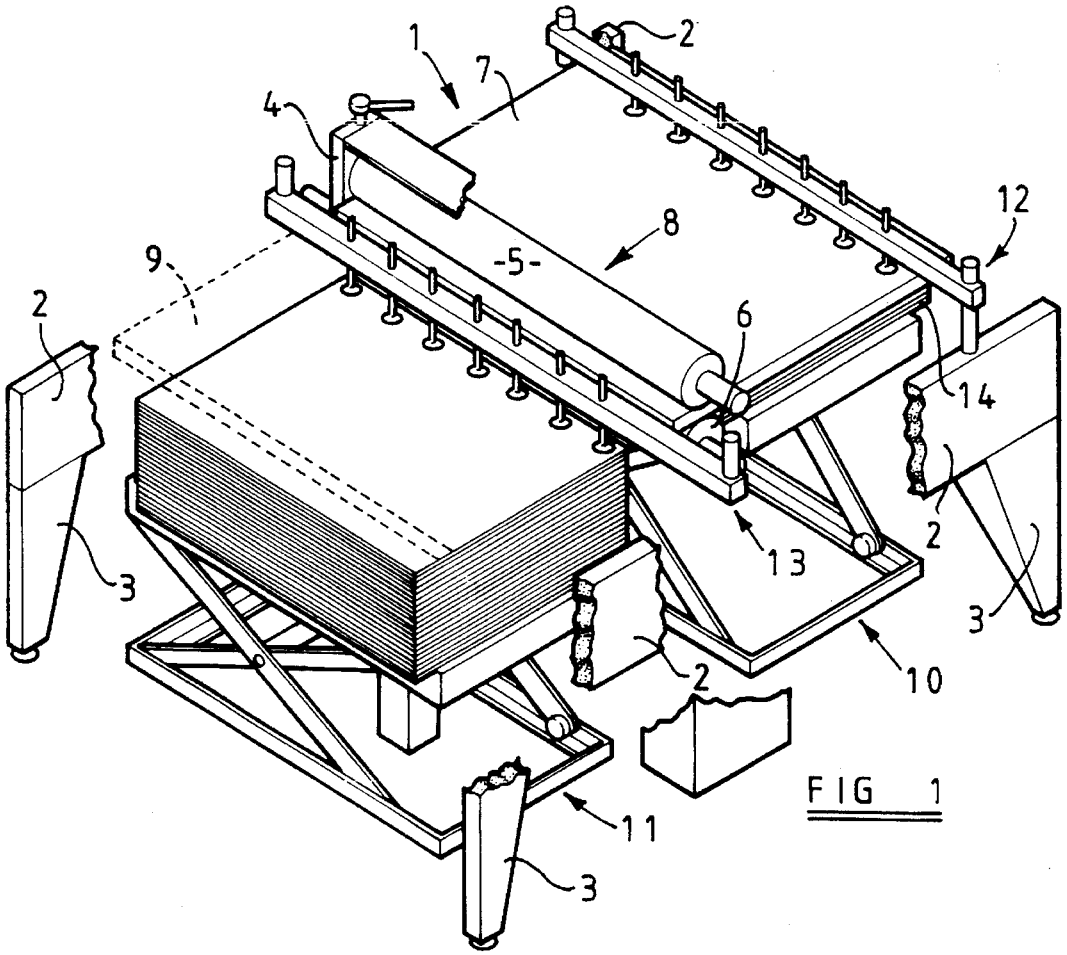
FIG. 1 is a perspective, diagrammatic view of a die-cutting press.
Figure 2:
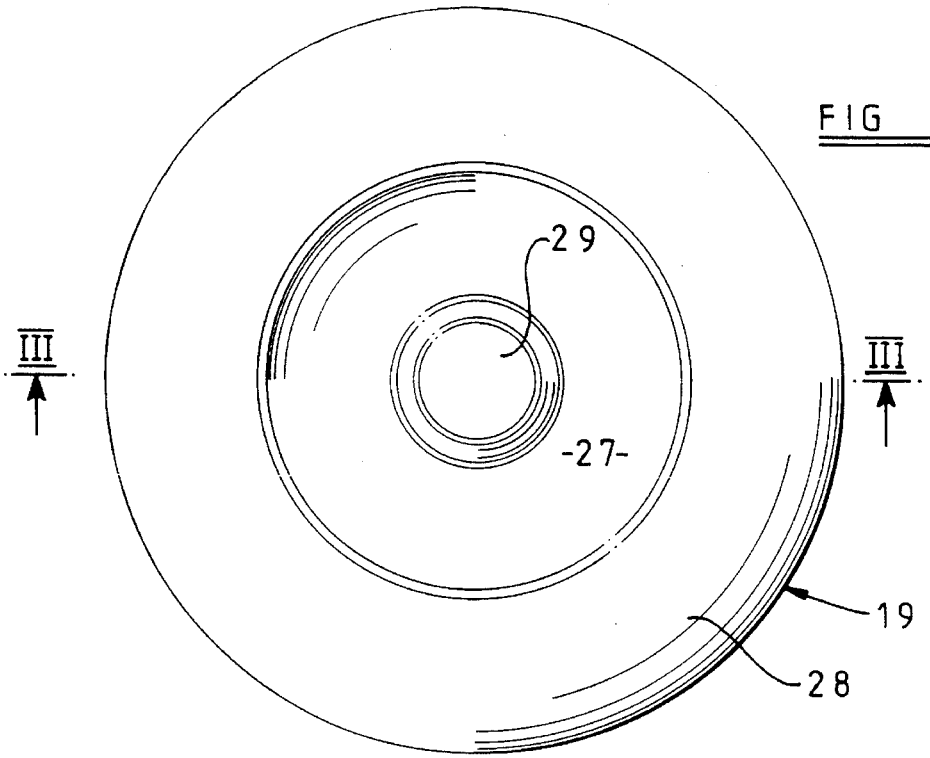
FIG. 2 is a plan view of one embodiment of a pneumatic ejector according to the invention.

The press 1 shown in FIG. 1 is known from GB 2224967A and briefly comprises a frame 2 having legs 3 and a subframe 4 supporting a hollow steel pressing roller 5 and a hollow steel support roller 6. The frame 2 supports a movable bed 7 for supporting a die member 15 including cutting blades 16 (see FIGS. 5 and 6) for cutting a solid board sheet placed on the die member.

The bed 7 is movable horizontally in the direction of the arrow 8 in synchronism with the rollers 5 and 6 from a loading position slightly removed from the position shown in FIG. 1 to a discharge position 9 shown in broken lines and back to the loading position. In moving to and fro between the loading position and the discharge position the bed 7 and the first die member pass between the pressing roller 5 and the support roller 6.

The press 1 also comprises two vertically adjustable tables 10 and 11 arranged below the loading position and the discharge position, respectively, a loading mechanism 12 and a discharge mechanism 13. When the bed 7 is in the discharge position 9, the loading mechanism 12 picks up a solid board sheet from a stack of sheets 14 on the table 10 and places this sheet on the die member when the bed 7 has moved back to the loading position. The bed 7 with the die member and the sheet is then passed between the pressing roller 5 and the support roller 6 to the discharge position 9. In this discharge position, the sheet is removed from the die member by the discharge mechanism 13 and at the same time a fresh sheet is picked up by the loading mechanism 12. When the bed 7 has been drawn back to the loading position, the first-mentioned sheet is placed on the table 11 by the discharge mechanism 13.

As shown in FIGS. 5 and 6, the cut board 14 is trapped between the cutting blades 16 of the die member 15. These have to be ejected in order that the cut board can be removed from the die member 15 by the discharge mechanism 13. In order to eject the cut board, one or more pneumatic ejectors 17 are provided in the die member 15.

Referring now to FIGS. 2 to 6, the ejector comprises a rigid support member 18, preferably of metal and typically a zinc alloy die casting, and an elastomeric ejection element 19, typically of synthetic rubber. The support member 18 comprises a cylindrical base portion 20 and an upstanding boss 21 integral with the base portion 20. The base portion 20 has an air passage 22 extending diametrically therethrough and the boss 21 has a through bore 23 which communicates with the air passage 22. The boss 21 also has an annular, circumferential groove 24 defining a radially outwardly projecting flange 25 at the upper end of the boss 21. The through bore 23 tapers towards the air passage 22 and the upper end of the boss 21 is concave and more particularly is part spherical.

The ejection element 19 comprises a part spherical diaphragm portion 27 so as to be of complementary shape to the upper end of the boss 21 and a generally non expandable skirt portion 28 surrounding the diaphragm portion 27 and moulded to the boss 21. The diaphragm portion 27 has a first integral protrusion 29 upstanding from a central region of the diaphragm portion and a second integral protrusion 30 which depends from a central region of the diaphragm portion 27 and which extends into the through bore 23 in the boss 21.

Figure 3:
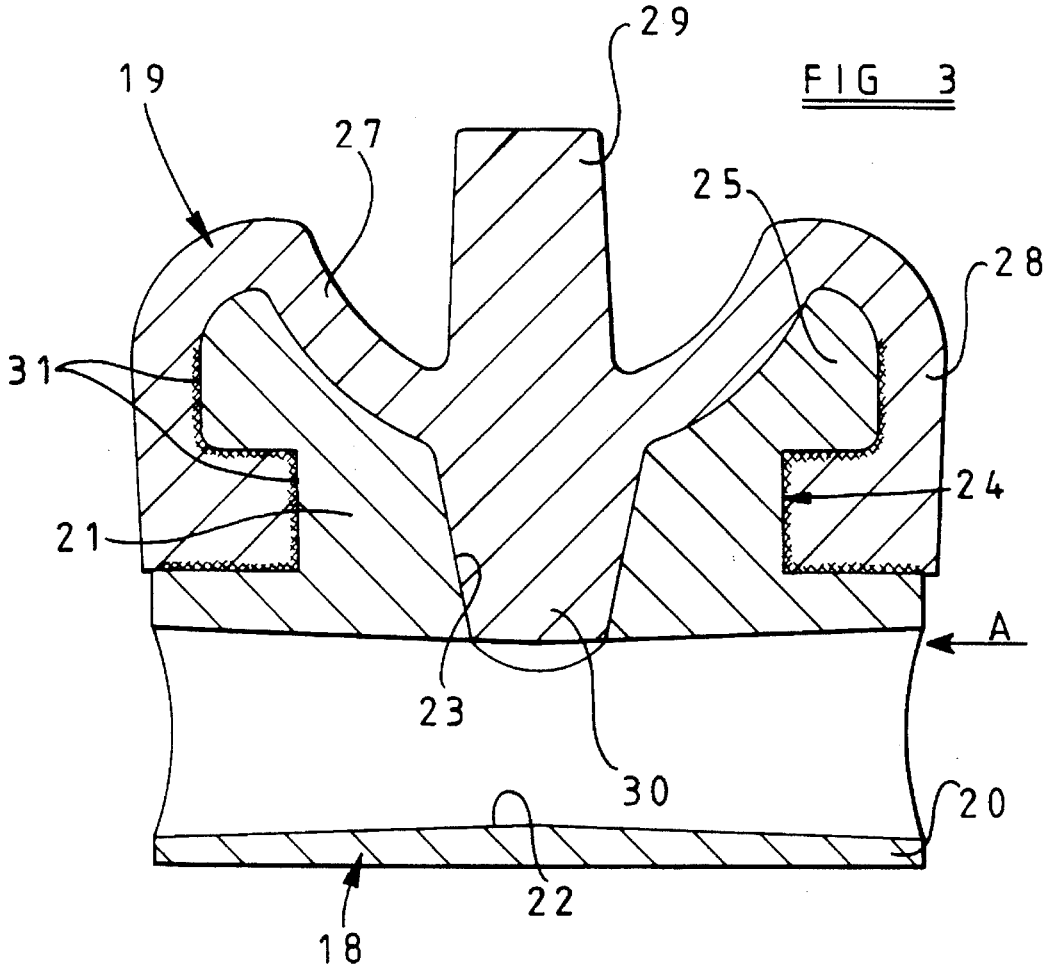
FIG. 3 is a section taken along line III—III of FIG. 2.
Figure 4:
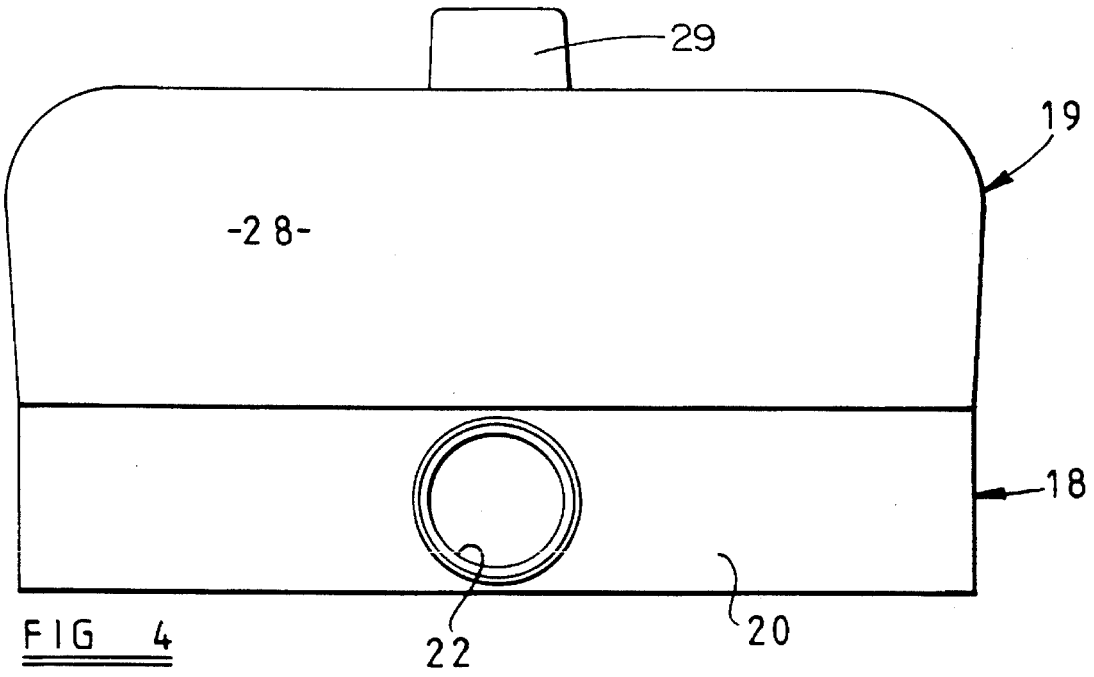
FIG. 4 is a side view taken in the direction of arrow A in FIG. 3.

In order to form the ejection element 19, the support member 18 is placed in a mould and adhesive is applied to the outer circumferential edge of the flange 25, the walls of the groove 24 and the upper surface of base portion 20 as shown by the hatched lines 31 in FIG. 3. The ejection element 19 is then moulded onto the support member 18.

In the absence of air under pressure in the passage 22, the diaphragm portion 27 will adopt the position shown in FIG. 5. When air is applied under pressure to the passage 22, the diaphragm portion 27 will move away from the boss 21 and the upstanding protrusion 29 will push the cut board 14 out of the blades 16 as shown in FIG. 6 so that the cut board 14 can be removed from the die member 15 by the discharge mechanism 13. When the air pressure is removed, the diaphragm portion will return to the position shown in FIG. 5.

In use, air is supplied to the passage 22 at appropriate times by air pipes 32 provided in the die member 15.

The pneumatic ejector 17 described above has many advantages over the known electors. It is more durable and will withstand a greater air pressure so that it can be operated to provide a greater ejection force. It can operate faster and uses less air. It can be made to a lower overall height and at a lower cost.

The ejector 17' shown in FIG. 7 differs from that shown in FIGS. 2 to 6 in that the boss 21' has no groove 24, but instead is provided with an integral, annular flange 35 provided with a plurality of regularly spaced apart apertures 36. Typically there are about fifteen such apertures. The skirt portion 28' of the ejection element 19' is moulded around the flange 35 and parts of the skirt portion 28' extend through the apertures 36 to help key the ejection element 19' to the boss 21'. In this case, the adhesive between the ejection element 19' and the boss 21' is not necessary.

The ejectors described above have particular application in die-cutting presses but may have other applications.

What is claimed is:

1. A pneumatic ejector comprising a rigid support member having a base portion and an upstanding boss integral with the base portion, and an elastomeric ejection element having a diaphragm portion and a peripheral portion surrounding the diaphragm portion, said peripheral portion being secured to the boss, the support member having an air inlet passage for supplying air under pressure to move the diaphragm away from the boss, the diaphragm having an integral protrusion upstanding from a central region of the diaphragm and extending in a direction away from said air inlet passage.

2. A pneumatic ejector as claimed in claim 1, wherein the peripheral portion is moulded onto the upstanding boss.

3. A pneumatic ejector as claimed in claim 1, wherein the peripheral portion is bonded to the upstanding boss by adhesive.

4. A pneumatic ejector as claimed in claim 1, wherein the upstanding boss has an annular flange with a plurality of apertures therein and the peripheral portion is moulded around the flange and has parts extending through the apertures in the flange.

5. A pneumatic ejector as claimed in claim 1, wherein an upper end of the upstanding boss is concave and the diaphragm is of complementary shape.

6. A pneumatic ejector as claimed in claim 1, wherein the diaphragm has an integral protrusion which depends from a central region of the diaphragm and which extends into a through bore in the upstanding boss, said through bore communicating with the air inlet passage in the support member.

* * * * *